US005880752A

United States Patent [19]

Weber et al.

[11] Patent Number: 5,880,752

[45] Date of Patent: Mar. 9, 1999

[54] PRINT SYSTEM FOR INK-JET PENS

[75] Inventors: Timothy L. Weber, Corvallis; James P. Shields, Philomath, both of Oreg.

[73] Assignee: Hewlett-Packard Company, Palo Alto, Calif.

[21] Appl. No.: 647,347

[22] Filed: May 9, 1996

[51] Int. Cl.[6] ..... B41J 2/17

[52] U.S. Cl. ..... 347/15; 347/98; 251/129.06; 251/11

[58] Field of Search ..... 347/15, 98, 28; 251/11, 129.06

[56] References Cited

U.S. PATENT DOCUMENTS

| | | | |
|---|---|---|---|
| 4,050,078 | 9/1977 | Isayama et al. | 346/140 R |
| 4,480,259 | 10/1984 | Kruger et al. | 346/140 R |
| 4,494,128 | 1/1985 | Vaught | 346/140 R |
| 4,631,554 | 12/1986 | Terasawa | 346/140 R |
| 4,727,436 | 2/1988 | Kawamura et al. | 358/298 |
| 4,746,935 | 5/1988 | Allen | 346/140 R |
| 4,930,018 | 5/1990 | Chan et al. | 358/298 |
| 4,963,882 | 10/1990 | Hickman | 346/1.1 |
| 5,107,332 | 4/1992 | Chan | 358/80 |
| 5,129,794 | 7/1992 | Beatty | 417/413 |
| 5,371,529 | 12/1994 | Eguchi et al. | 347/7 |
| 5,681,024 | 3/1994 | Lisec et al. | 251/11 |

*Primary Examiner*—Valerie Lund
*Assistant Examiner*—Christina Annick

[57] ABSTRACT

A variable optical density print system and method for continuous variation of the optical density among successive droplets expelled from the same nozzle, the print system comprising a fluid channel connected to a basis fluid supply and a fluid channel connected to a colorant concentrate fluid supply. Each fluid channel is in fluid communication with a single ink firing chamber. Appropriate amounts of basis fluid and colorant concentrate fluid are delivered to the firing chamber by briefly opening a microvalve positioned within each fluid channel. The fluids mix in the firing chamber and are then ejected as a single ink droplet which possesses a desired optical density.

7 Claims, 3 Drawing Sheets

PRINT SYSTEM FOR INK-JET PENS

FIELD OF THE INVENTION

The present invention relates to a print system for varying optical density of printed images printed by ink-jet pens.

BACKGROUND AND SUMMARY OF THE INVENTION

An ink-jet printer includes a pen in which small droplets of ink are formed and ejected toward a printing medium. Such pens include printheads with orifice plates with several very small nozzles through which the ink droplets are ejected. Adjacent to the nozzles are ink chambers, where ink is stored prior to ejection through the nozzle. Ink is delivered to the ink chambers through ink channels that are in fluid communication with an ink supply. The ink supply may be, for example, contained in a reservoir part of the pen.

Ejection of an ink droplet through a nozzle may be accomplished by quickly heating a volume of ink within the adjacent ink chamber. The thermal process causes ink within the chamber to superheat and form a vapor bubble which, in turn, forces a drop of ink through the nozzle. This process is called "firing." The ink in the chamber may be heated with, for example, a resistor that is aligned adjacent to the nozzle.

Ejection of an ink droplet through a nozzle may also be accomplished through use of a piezoelectric element. A piezoelectric element is responsive to a control signal for abruptly compressing a volume of ink in the firing chamber thereby producing a pressure wave that forces the ink drops through the printhead orifices.

As the ink-jet pen traverses the surface of the print medium, droplets of ink are fired from the ink chambers, through the nozzles and toward the print medium. The droplets strike the medium and then dry to form dots that, when viewed together, create the printed image.

Good print quality is an important consideration in ink-jet printing. In order to print sharper and more definite images, either the printer resolution or the printer gray scale capabilities, or both, must be increased. Printer resolution is generally referred to as the number of dots per inch (dpi) the printer is capable of producing.

Gray scale print capability is the ability to produce printed images possessing shades of color which are only slightly distinguishable from one another. Gray scale print capability is often referred to or measured in terms of character darkness (i.e., blackness). Character darkness is also referred to as optical density.

In ink-jet printing, optical density has been varied in a step-wise manner only. One approach to increasing the optical density is to put multiple drops having the same optical density in the same position on the print medium. However, such an approach generally requires multiple passes of the pen thus, taking longer to print and requiring a significant amount of ink. Additionally, it is difficult to align multiple droplets in the same position. Poorly aligned droplets can result in printed images that appear fuzzy and soft. Moreover, multiple ink droplets prolong drytime, slowing print speed.

Another approach to varying optical density is to provide different ink reservoirs, in a multi-reservoir pen, with differing colorant loads of the same color ink. Alternatively, separate ink-jet pens with differing dye loads of the same color ink may be used. Dye load is a measure of the concentration of dye typically dissolved in an ink vehicle, such as, a mixture of water and organic solvent. With each of these approaches, ink from a plurality of ink supplies, typically three ink supplies, one of each light, medium and dark optical density ink, are combined on a print medium in order to improve gray scale capability. Thus, for a color ink-jet print system, which generally requires subtractive primary ink colors cyan, magenta and yellow, nine separate ink supplies (not including black ink) would be required. Accordingly, these approaches require a number of ink reservoirs or pens and, hence are expensive, complex systems that only vary optical density in a step-wise manner with a limited number of gray scale levels.

The present invention provides a variable optical density print system and method for continuous variation of the optical density among successive droplets expelled from the same nozzle. Having the ability to continuously vary the optical density of successive droplets provides the best possible gray scale control with a virtually limitless number of gray scale levels achieved. When combined with an ink-jet pen having sufficient resolution capability, the present invention generally provides printed images having excellent sharpness and definition.

The variable optical density print system of the present invention generally comprises two fluid channels, one channel in fluid communication with a basis fluid supply and the other channel in communication with a colorant concentrate fluid supply. Both fluid channels are in fluid communication with a single ink firing chamber. Depending upon the desired optical density of a given droplet, appropriate amounts of basis fluid and colorant concentrate fluid are delivered to the firing chamber by briefly opening a microvalve positioned within each fluid channel. The fluids mix in the firing chamber and are then ejected as a single ink droplet which possesses the desired optical density.

DESCRIPTION OF PREFERRED EMBODIMENTS

The apparatus comprising the continuously variable optical density print system of the present invention is explained first, followed by an explanation of the operation of the print system.

Figure 1:
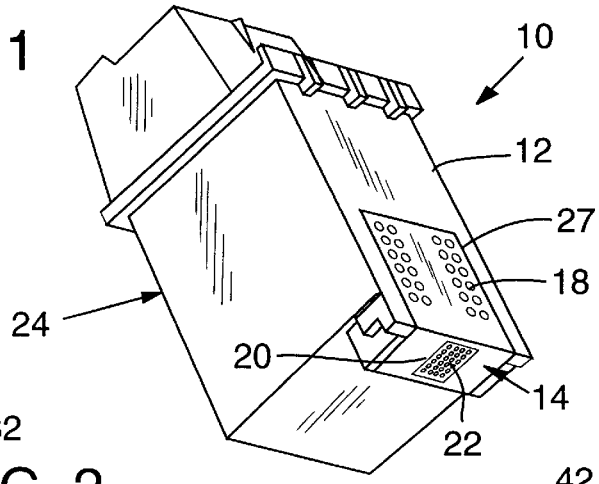
FIG. 1 is a perspective view of an ink-jet pen incorporating a variable optical density print system in accordance with the present invention.

Referring to FIG. 1, the variable optical density print system of the present invention is incorporated within an ink-jet pen 10. The preferred pen includes a pen body 12 defining a reservoir 24. The reservoir 24 may be configured to hold quantities of fluids. A printhead 20 is fit into the bottom (or base) 14 of the pen body 12 and controlled for ejecting droplets.

Figure 2:
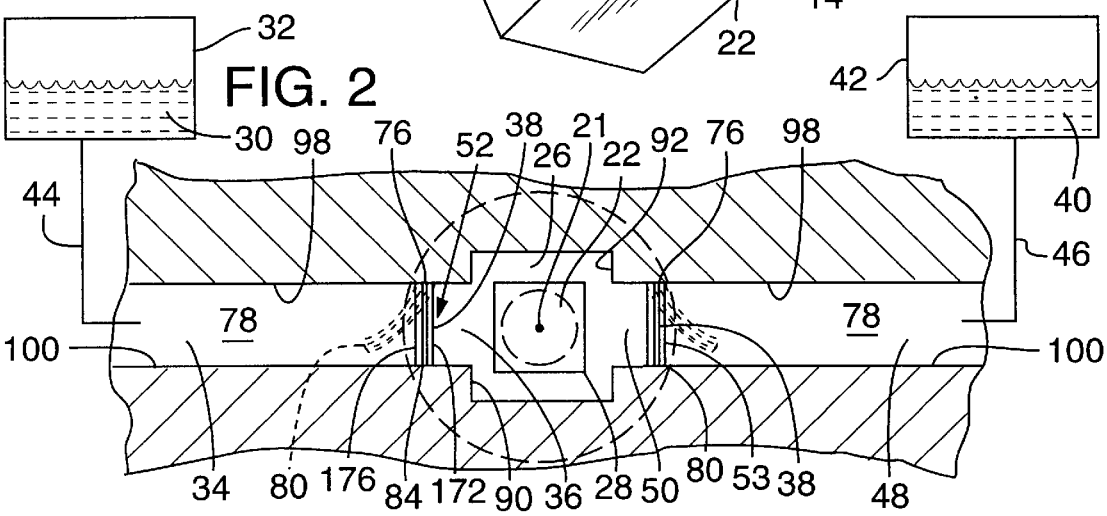
FIG. 2 is a diagram of a variable optical density print system in accordance with the present invention.

The printhead has an outer plate that defines a set of nozzles 22 for expelling fluid in a controlled pattern during printing. Each nozzle 22 is in fluid communication with a firing chamber 26 (FIG. 2). The firing chamber is defined in the base 14 of printhead 20 to which the outer plate is attached. The firing chamber 26 is cubical in shape, preferably, with a height (measured perpendicular to the plane at FIG. 2) of about 25 $\mu$m, a width of about 40 $\mu$m, and a length of about 40 $\mu$m. Other firing chamber shapes are acceptable. FIG. 2 represents an enlarged bottom view of FIG. 1, with the outer plate of the printhead cutaway to expose the components underlying the nozzles. Each firing chamber 26 has associated with it a flat, thin-film resistor 28 centered under the nozzle. The resistor surface is positioned perpendicular to a central axis of the nozzle 22, which axis appears as a point 21 in FIG. 2. The firing resistor 28 is positioned on, and connected to, the lower surface of the firing chamber 26. Each resistor 28 is selectively driven (heated) with a sufficient current to instantly vaporize some of the fluid in the chamber 26, thereby forcing a droplet through the nozzle 22.

Conductive drive lines to each resistor 28 are carried upon a circuit 27 mounted to the exterior of the pen body 12. Circuit contact pads 18 (shown enlarged for illustration) at the ends of the resistor drive lines engage similar pads carried on a matching circuit attached to the printer carriage (not shown). The signal for firing the resistors 28 is generated by a microprocessor and associated drivers that apply firing signals to the resistor drive lines.

In a preferred embodiment of the present invention, the system includes a basis fluid supply 32 that may be stored within the pen reservoir 24 or may comprise any container suitable for storing a supply of basis fluid 30 (FIG. 2). The basis fluid 30 preferably comprises an untoned (colorless) or slightly colored liquid having a viscosity of about 1.5 to about 10 cP such that the liquid may be ejected from an ink-jet printhead. The basis fluid 30 may comprise, for example, a solution of about 5 wt. % 1, 5-pentanediol. Preferably, the basis fluid would also contain a surfactant, such as, about 2.0 wt. % Surfynol 465 manufactured by Air Products of Allentown, Pa., to prevent bleed between adjacent printed images of different ink colors. The term "bleed" refers to a ragged border between adjacent, printed ink colors resulting from one ink color invading the border of the adjacent ink color. A biocide, such as 0.2 wt. % Proxel GXL manufactured by ICI Chemicals of the United Kingdom, may also be added to the basis fluid.

The basis fluid 30 may also comprise low dye load liquids such as, for example, a mixture of about 5 wt. % 1, 5-pentanediol with about 0.1 to about 0.4 wt. % solution of sodium AR52 magenta dye available from Crompton and Knowles of Charlotte, N.C. Alternatively, the dye AR52 may include other counter ions associated with the dye such as, potassium AR52 or lithium AR52. The particular basis fluids discussed are intended to be illustrative only. The basis fluid 30 may comprise other fluid systems such as, for example, a pigment-based fluid system or a microemulsion fluid system.

As noted, the basis fluid supply may be incorporated into the pen body 12 in reservoir 24. Alternatively, the basis fluid supply may be a remote container (that is, remote from the moving pen), as illustrated in FIG. 2. A basis fluid supply conduit 44 conducts basis fluid 30 from basis fluid supply 32 to a first or basis fluid channel 34 formed within the base of the printhead 20 that is mounted to the pen body 12. The basis fluid channel 34 is configured so that basis fluid 30 moving therethrough flows to an entry region 36 or opening of a firing chamber 26.

The system additionally includes a colorant concentrate fluid supply 42 that may be stored in the pen reservoir 24 or may comprise any container suitable for storing a supply of colorant concentrate fluid 40. The colorant concentrate fluid 40 preferably comprises a high dye load liquid such as, for example, a mixture of about 5 wt. % 1, 5-pentanediol and about 2.0 wt. % to about 2.5 wt. % AR52 magenta dye. A surfactant such as, about 2.0 wt. % Surfynol 465 and a biocide such as, 0.2 wt. % Proxel GXL may also be added to the high dye load mixture.

The amount of dye (e.g., AR52) to be used in the colorant concentrate fluid 40 is primarily dependent upon the specific dye chosen and the extinction coefficient (also known as the absorptive power) of the dye (i.e., whether the dye is a strong or weak dye). The colorant concentrate fluid discussed is intended to be illustrative only. Other liquids having a high colorant strength and a viscosity suitable for ejection from an ink-jet pen, may be used as the colorant concentrate fluid 40. Not only may other dyes be suitable, but the colorant concentrate fluid 40 may also comprise, for example, a pigment-based fluid system or a microemulsion fluid system.

A second supply conduit 46 (colorant concentrate supply conduit) conducts colorant concentrate fluid 40 from the colorant concentrate fluid supply 42 to a second (or colorant concentrate) fluid channel 48 formed within the base 14 of the printhead 20. The colorant concentrate fluid channel 48 is configured so that colorant concentrate fluid 40 moving therethrough flows to a second entry region 50 or opening of the firing chamber 26.

In the preferred embodiment of the present invention illustrated in FIG. 2, the basis fluid channel 34 and colorant concentrate fluid channel 48 both extend laterally from the firing chamber 26 and generally perpendicular to the central axis 21 of the nozzle 22. The colorant concentrate fluid channel 48 is positioned substantially colinearly with the basis fluid channel 34 with the first opening 36 and the second opening 50 to the firing chamber 26 positioned on opposing side walls 90, 92 of the firing chamber 26 (FIG. 2). Thus, fluids flowing through the channels flow into the firing chamber from opposing directions. The turbulence caused by the opposing fluid flows facilitates mixing of the fluids in the firing chamber.

Each fluid channel 34, 48 includes a metering device 52, 53 interposed between the firing chamber 26 and its associated supply conduit 44, 46. For convenience in describing the metering devices 52, 53 below, both the basis fluid channel 34 and its associated supply conduit and the colorant concentrate fluid channel 48 and associated supply conduit 46 are generally referred to as fluid channels and fluid supply conduits.

Each fluid channel comprises a lower surface 78, an upper surface (not shown in FIG. 2) and two side walls 98, 100. The channels are substantially rectangular in cross-section with preferred dimensions of 30 $\mu$m in width and 50 $\mu$m in length.

The metering devices 52, 53, preferably active valve members 38 described in detail below, are operable for restricting fluid flow through the respective fluid channels to the firing chamber 26. The metering device is opened and closed to allow a precise amount of fluid to flow from the fluid channel to the firing chamber 26.

The metering devices for each fluid operate and are fabricated in the same manner. Referring to FIG. 2, in a preferred embodiment of the present invention a metering device 52 comprises a valve member 38 (or flap) constructed of resiliently deformable materials. The valve member 38 is movable into and out of an open (dashed lines, FIG. 2) and a closed position (solid lines, FIG. 2).

Preferably, the valve member 38 is placed within the fluid channel, adjacent the firing chamber 26, so that the closed valve member 38 occludes the junction between the fluid channel and the opening to the firing chamber.

The valve member 38 is affixed at one end 76 to a side wall 98 of the fluid channel. The other, free end 80 of the valve member 38 is free to move within the fluid channel. When the valve 38 is closed, the free end 80 is positioned very close to flush against the opposing fluid channel side wall 100. The upper side 102 and lower side 104 (not shown in FIG. 2, see FIG. 3) of the closed valve member 38 are substantially flush with the upper and lower surfaces of the fluid channel, respectively. Consequently, the closed valve member 38 substantially occludes fluid flow through the channel and to the firing chamber 26. There exists enough space between the free end 80 and sides of the valve member 38 and the fluid channel such that the valve member is movable between the open and closed position.

The valve member 38 is selectively deformable or deflectable into an open position for allowing fluid flow from the fluid channel to the firing chamber 26. In accordance with a preferred embodiment of the invention, the valve member 38 is constructed to include two layers or portions of deformable material. Each of the layers comprise materials possessing different coefficients of thermal expansion.

When the valve member 38 is heated, one layer of the valve member undergoes relatively less thermal expansion than the other layer. The layers are arranged so that the differing thermal expansions cause the valve member 38 to deflect or bow in a direction away from the firing chamber 26, into the fluid channel. The valve member 38 deflection allows a precise amount of fluid to flow from the fluid channel to the firing chamber 26.

The preferred valve members 38 include a third, middle layer of deformable material. The middle layer possesses high thermal conductivity. The middle layer is provided with current to act as a heating element 84, causing the valve member 38 to deflect to the open position when heated.

The valve member 38 is heated for a preselected period of time, and hence opened or closed, by applying or removing current, respectively, to one of the layers. Current is applied to the layer acting as the heating element. The heating element may be any electrically conductive layer of the valve member 38 that comprises a material having a high thermal conductivity. Drive lines to each valve member 38 are carried upon the circuit 26 that is mounted to the exterior of the pen body 12.

The valve member 38 of the above described embodiment may comprise any of a variety of material layers. In a preferred embodiment, the valve member 38 may comprise two layers of metal. Each metal layer possesses a different coefficient of thermal expansion (i.e., the valve member 38 is bimetallic). The valve member 38 may also comprise a layer of polyimide (or a similar compound) and a metal layer, or may comprise two polyimide layers with a conductive layer 84 therebetween.

The general fabrication process (often referred to as microfabrication) of the valve member 38 of the metering devices 52 and 53 is depicted in FIGS. 5A–5E.

In a preferred embodiment, valve member 38 comprises a substrate 58, also referred to as a thin-film stack. The substrate may include, from bottom to top, a p-type silicon layer having a thickness of about 675 $\mu$m, covered with a layer of silicon dioxide about 12,000 Å thick; a passivation layer having a thickness of about 7,500 Å; an electrically conductive aluminum layer having a thickness of about 1,000 Å; a resistor layer having a thickness of about 5,000 Å; and another passivation layer having a thickness of about 6,000 Å.

Figure 5A:
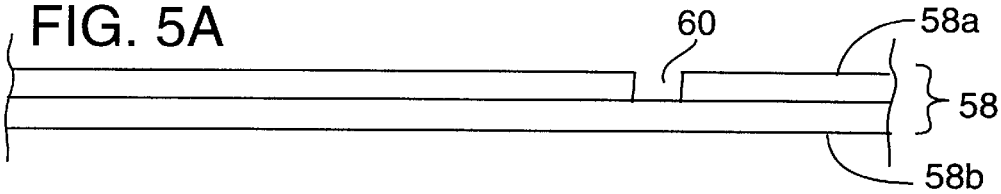
FIGS. 5A–5E are enlarged cross-sectional views depicting the fabrication of a valve device incorporated in an embodiment of the present invention.

In FIG. 5A, the lower layers (silicon, silicon dioxide, lower passivation layer) are for convenience shown as a single layer **58*b*. The remaining upper layers of substrate are shown as a single layer 58*a***.

Substrate 58 is masked with positive or negative photoresist. The substrate 58 is then patterned and anisotropically etched through the conductor, resistor and passivation layer **58*a* of the substrate to define a via 60 for connection of the valve member 38 to the electrical traces layer within the substrate. The via 60 provides an electrical passageway for driving the valve member 38** through selective application of current for a preselected period of time.

Figure 5B:
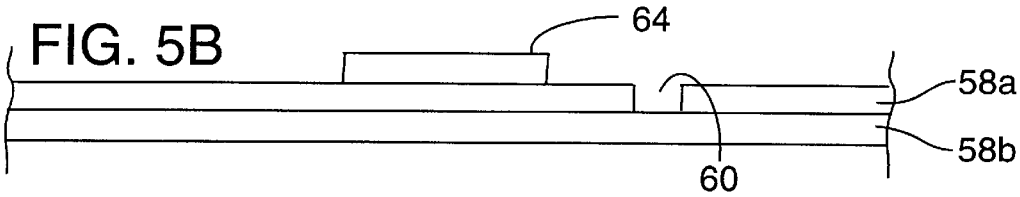

A sacrificial layer 64 is next deposited using low pressure chemical vapor deposition (LPCVD), plasma enhanced chemical vapor deposition (PECVD) or a spin-on process. The sacrificial layer 64 is preferably a low temperature oxide, but may also comprise a layer of photoresist or polyimide. Preferably, the sacrificial layer 64 is 1 to 2 microns in thickness. The sacrificial layer 64 is then patterned and etched to define what will be a clearance space directly beneath the valve member 38 (FIGS. 2 and 5B). The patterned sacrificial layer 64 will be removed later in the fabrication process to enable one end of the valve member 38 to move relative to the substrate 58.

Figure 5C:
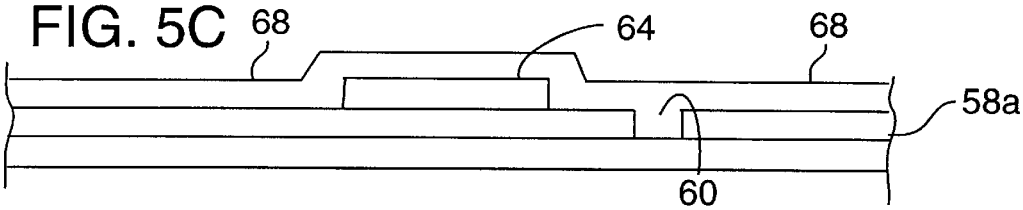
Figure 5D:
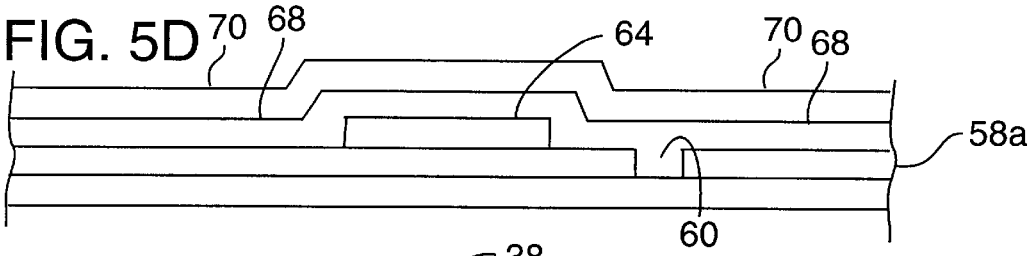

In a preferred embodiment, the valve member 38 is bimetallic. Accordingly, a first metal layer 68 is deposited upon both the substrate 58 and the patterned sacrificial layer 64 (FIG. 5C). The first metal layer 68 fills the via 60, providing electrical connection with the traces layer in the substrate, hence between the microprocessor and valve member 38 through the substrate 58. A second metal layer 70 is deposited over the first metal layer 68 (FIG. 5D). Both the first and second metal layers are preferably sputter deposited in thicknesses of 1 to 4 microns per layer. Preferred metal layers comprise aluminum, palladium, gold, platinum, tantalum and mixtures thereof. The metal selected for the second layer has a lower coefficient of thermal expansion as compared to the metal selected for the first layer.

Figure 3:
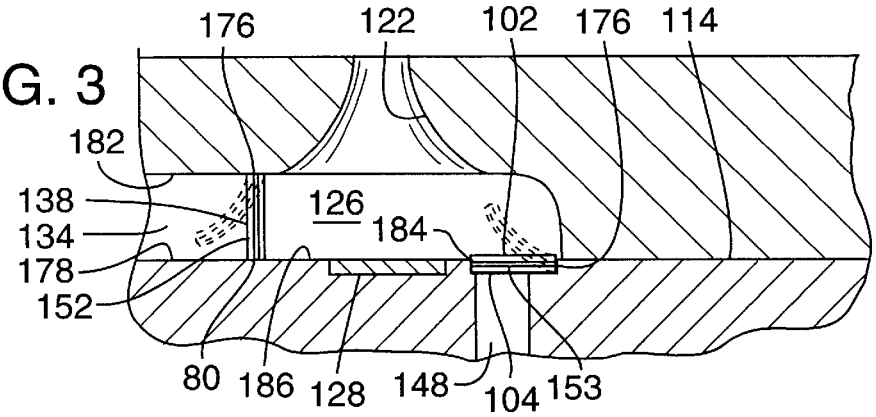
FIG. 3 is an enlarged cross-sectional view of an alternative embodiment of the variable optical density print system.
Figure 5E:
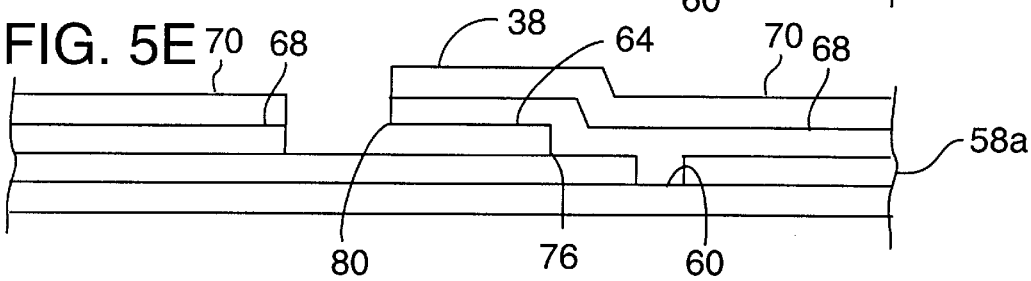

A positive or negative photoresist layer is deposited on the outer metal layer 70. The photoresist layer is patterned to define in the metal layers 68, 70, the shape of a valve member 38. Specifically, both the first layer 68 and second layer 70 are etched through on two sides of the sacrificial oxide layer 64, thereby defining the free end 80 and sides of the valve member 38. The sacrificial layer 64 is then removed, releasing the free end 80 and sides of the valve member 38 from contact with the substrate 58 (FIG. 5E). The portion of the substrate 58 extending from the fixed end 76 of the valve member is removed by conventional sawing techniques and the valve member is then affixed to the fluid channel side wall 98 at the above-described location (FIG. 3).

In another preferred embodiment, the second layer 70 of the valve member 38 may comprise a baked polyimide layer. The polyimide layer 70 is preferably 2 to 8 $\mu$m in thickness. The first metal layer 68 acts as a thermally conductive heating element. The fabrication process parallels the fabrication process above with the exception that the first (metal) layer 68 and the second (polyimide) layer 70 must be etched separately. Moreover, the polyimide layer is baked (e.g., heated between 130° and 220° C. for about 30 minutes), prior to etching to define the valve member 38.

In the embodiment of FIG. 2, the first and second layers of the valve member 138 may both comprise baked polyimide layers. A third, middle layer, of highly conductive material acts as a heating element 84 (FIG. 2). The fabrication process is shown generally in FIGS. 6A–6F, whereby a substrate 158 is first masked with positive or negative photoresist. The photoresist is patterned, and the substrate is anisotropically etched through the passivation layer 162 of the substrate to define a via 160. The via 160 provides for connection of the valve member 138 to electrical traces within the substrate 158.

A sacrificial layer 164 is deposited using LPCVD, PECVD or a spin-on process. The sacrificial layer 164 is preferably a low temperature oxide, but may also comprise a layer of photoresist or polyimide. Preferably, the sacrificial layer 164 is 1 to 2 microns in thickness. The sacrificial layer 164 is patterned and etched to define what will become a clearance space directly beneath the valve member 138 (FIG. 6F). The patterned sacrificial layer 164 will be removed later in the fabrication process to enable the free end 180 of the valve member 138 to move relative to the substrate 158.

Figure 6A:
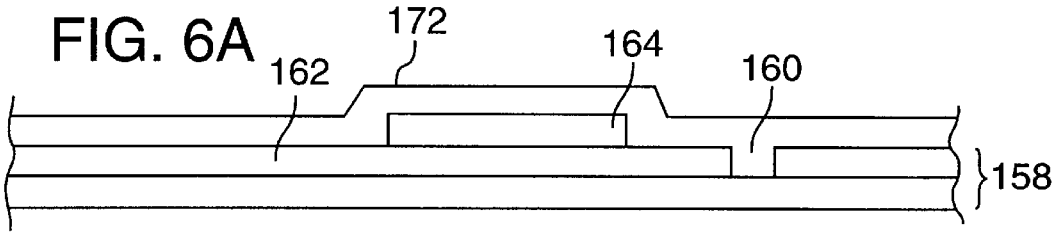
FIGS. 6A–6F are enlarged cross-sectional views depicting the fabrication of another valve device incorporated in an embodiment of the present invention.
Figure 6B:
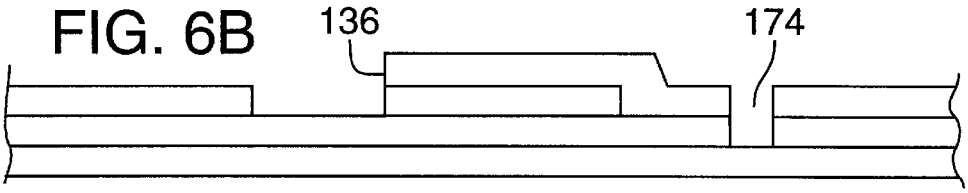
Figure 6C:
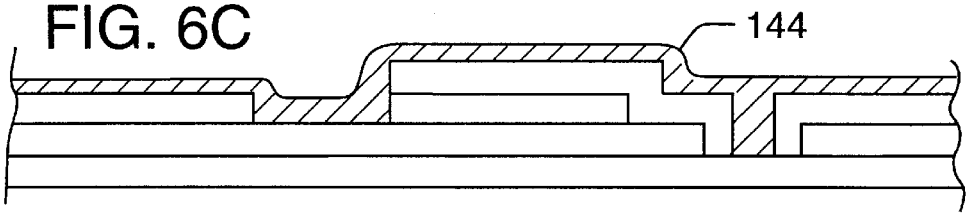
Figure 6D:
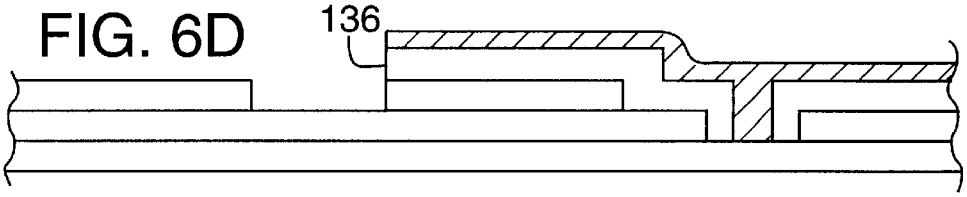

A first polyimide layer 172 is deposited upon both the substrate 158 and the patterned sacrificial layer 164 (FIG. 6A). The first polyimide layer 172 fills the via 160. The polyimide layer 172 is baked at about 200° C. for about 30 minutes, patterned and etched on two sides of the sacrificial layer to define the valve member 38 including its free end 80. The first polyimide layer 172 is also patterned and etched to create a second via 174 (FIG. 6B). A thin layer of conductive material 144 is deposited, preferably by a sputtering process (FIG. 6C). The layer of conductive material acts as the heating element 84 (FIG. 2), and is preferably, about 1 micron in thickness. The heating element layer 144 is then patterned and etched to conform to the shape of the valve member 138 (FIG. 6D).

Figure 6E:
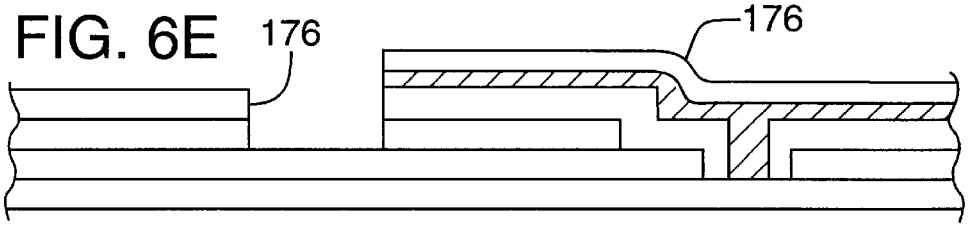
Figure 6F:
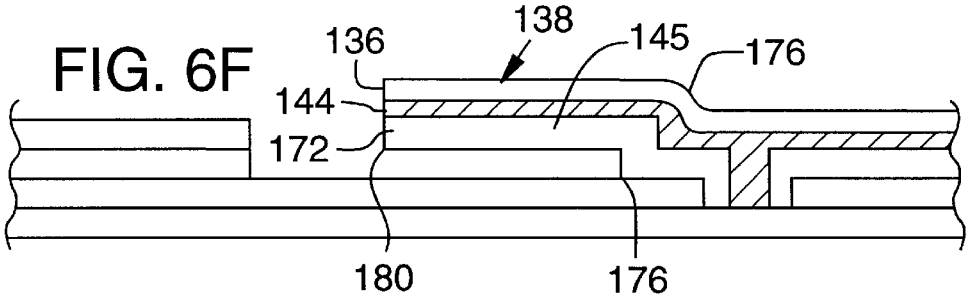

A second layer of polyimide 176 is deposited, patterned and etched to conform to the shape of the valve member 138 (FIG. 6E). The second polyimide layer 176 is baked at a lower temperature (e.g. 100° C.) relative to the inner polyimide layer 172. The higher the baking temperature of the polyimide layer, the higher the coefficient of thermal expansion of the polyimide. As discussed above, the differing thermal conductivities of the valve member layers determines the direction and extent of deflection of the valve member 138.

The sacrificial layer 164 is removed, enabling the free end 180 and sides of the valve member 138 to move relative to the substrate 158 (FIG. 6F). The portion of the substrate extending in a direction from the fixed end 176 toward the free end 180 of the valve member 138 is removed by conventional sawing techniques. The valve member is then attached to the fluid channel side wall 98 at the above-described location (FIG. 2).

Metering devices other than the above described deformable valve members may be used. Discrete, commercially available microvalves such as a FLUISTOR™ valve made by Redwood Microsystems of Menlo Park, Calif., or an electrically-activated, micromachined diaphragm valve made by IC Sensors of Milpitas, Calif., may be bonded within the fluid channels to selectively deliver precise volumes of fluid to the firing chamber 26. The dimensions of the fluid channels may be altered appropriately to accommodate such commercially available microvalves.

Another preferred embodiment of the present invention provides a basis fluid channel 34 and a colorant concentrate fluid channel 48 each in fluid communication with firing chamber openings that are positioned near diagonally opposed corners of the firing chamber. Thus, when metering devices 52 in each of the fluid channels are opened to deliver basis fluid 30 and colorant concentrate fluid 40 to the firing chamber 26, the mixture tends to swirl within the chamber, thereby providing effective mixing of the fluids prior to droplet ejection.

In yet another embodiment of the present invention, illustrated in FIG. 3, the basis fluid channel 134 is connected to a firing chamber 126 opening located on a side wall or corner of the firing chamber. The colorant concentrate fluid chamber is connected to a firing chamber 126 opening located beneath or positioned on the lower surface 186 of the firing chamber.

The basis fluid channel 134 is defined by the printhead base 114 to direct flow generally horizontally into the firing chamber 126 (parallel to the lower surface 186 of the firing chamber). The colorant concentrate fluid channel 148 is defined to be substantially perpendicular to the lower surface 186 of the firing chamber. The opening of the colorant concentrate fluid channel 148 into the lower surface of the firing chamber 126 is adjacent the firing resistor 128.

In the embodiment illustrated in FIG. 3, a valve member 138 comprising the colorant concentrate metering device 153 is mounted to the lower surface of the firing chamber 126 within a recess that surrounds the opening of the fluid channel 148. It is notable that other metering devices are acceptable in this location. The valve member 138 is located such that when closed (solid lines, FIG. 3), the valve member 138 covers the junction between the firing chamber 126 and the colorant concentrate fluid channel, thereby occluding fluid flow to the firing chamber.

The valve member 138 of metering device 153 remains in a closed position until a precise amount of colorant concentrate fluid is to be delivered to the firing chamber 126. The valve member 138 is then deflected to an open position for a brief, preselected period of time by application of current to the heating element 184 of the valve member.

In the preferred embodiment illustrated in FIG. 3, the valve member 138 deflects by the same operation described above with respect to valve member 38. The valve member 138 remains in an open position long enough for a precise amount of colorant concentrate fluid to be delivered to the firing chamber 126. This particular preferred embodiment ensures complete occlusion of fluid flow between the fluid channel 148 and the firing chamber 126 when the valve member 138 is in a closed position.

It is understood that in the above described embodiment (FIG. 3), the colorant concentrate fluid channel 148 could serve as the basis fluid channel and vice versa.

Figure 4:
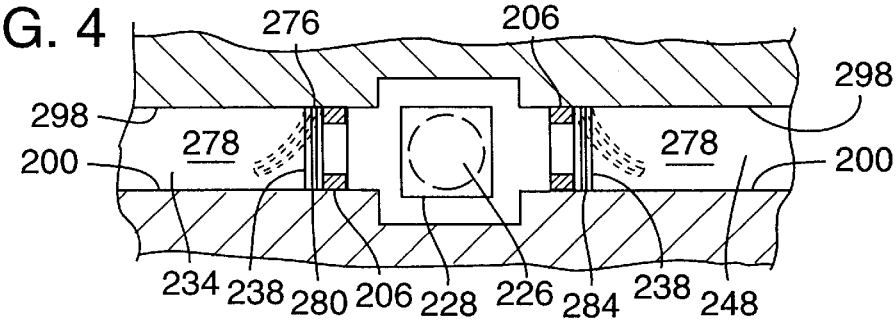
FIG. 4 is a diagram of an alternative embodiment of a variable optical density print system.

In another preferred embodiment of the present invention, illustrated in FIG. 4, the opening between the basis fluid channel 234 and firing chamber 226 and the opening between the colorant concentrate fluid channel 248 and the firing chamber each include a protrusion or seat 206 around the periphery of the channel. The seat decreases the size of the opening between the fluid channel and the firing chamber such that the opening is smaller in dimension than the side wall of the valve member 238. Thus, when in a closed position, the valve member 238 is flush against the seat, ensuring complete occlusion of fluid flow to the firing chamber 226.

The seat 206 preferably protrudes into the interior of the fluid channel by an amount such that fluid flow from the fluid channel to the firing chamber 226 is not significantly restricted by the seat 206 when the valve member 238 is in an open position (depicted by dashed lines in FIG. 4).

In another alternative of the present invention, the print system includes a supply container and fluid channel for delivering to the firing chamber a cleaning fluid such as, for example, the colorless basis fluid described above. Cleaning fluid is occasionally delivered to and ejected from the firing chamber to ensure that the firing chamber does not become contaminated with excess basis or colorant concentrate fluids.

OPERATION

The system may be provided with a pressurized basis fluid supply 32 and a pressurized colorant concentrate fluid supply 42 or may rely on capillary forces within the fluid channels 34, 48, to produce a fluid flow through the fluid channels to the firing chamber 26. The metering devices 52, 53 in each fluid channel, are normally in a closed position.

The desired optical density of each droplet is determined by the microprocessor. Dependent upon the desired optical density of a given fluid droplet, the basis fluid channel 34, metering device 52, the colorant concentrate fluid channel 48, and the metering device 53 are briefly opened for a preselected period of time to allow a precise volume of fluid to flow from the fluid channel to the firing chamber 26.

The amounts of basis fluid and colorant concentrate fluid delivered to the firing chamber 26 is dependent upon the dimensions of each respective fluid channel 34, 48, the flow rate of the fluids within each fluid channel and the period of time the metering device 52 is in an open position.

The basis fluid and the colorant concentrate fluid are simultaneously delivered to the firing chamber 26. The fluids contact and mix in the chamber prior to heating of the firing resistor 28. As the resistor 28 within the firing chamber 26 is heated, the mixture is ejected as a droplet through the nozzle 22 and to the print medium, as described above. The system is then ready to deliver, mix and eject the next droplet at the desired optical density level.

The volume of basis fluid relative to the volume of colorant concentrate fluid for each droplet varies depending upon the desired optical density of a given droplet. However, preferably, the total volume of ejected droplet (i.e., the sum of the basis fluid volume and the colorant concentrate fluid volume delivered to the firing chamber) remains constant. Thus, the same total volume of fluid enters the firing chamber prior to ejection regardless of the desired optical density of the droplet. In this manner, droplet size is controlled while the optical density range is continuously varied.

It is contemplated that printheads of the print systems of above described embodiments will include a plurality of firing chambers 26 and associated nozzles 22. In a preferred embodiment, some nozzles 22 may be permanently dedicated to ejecting higher optical density droplets, while other nozzles are dedicated to ejecting lower optical density droplets. Operation in this manner reduces the risk of cross-contamination of droplets of greatly varying optical density within a single firing chamber.

Having described and illustrated the principles of the invention with reference to preferred embodiments, it should be apparent that the invention can be further modified in arrangement and detail without departing from such principles. For example, the print system could include another fluid supply for providing fluids which, upon contact with the basis fluid and/or the colorant concentrate fluid, enhance drytime, fastness, solidification and/or color formation of the fluid mixtures.

We claim:

1. A print method for an ink-jet pen for continuously varying optical density, the print method comprising the steps of:

selectively delivering a precise quantity of first fluid through a first fluid channel to a firing chamber by providing a resiliently deformable first valve member having two portions, each of the two portions being metal and one portion having a different coefficient of thermal expansion than the other portion, and a heater for heating the first valve member, the first valve member being mounted within the first fluid channel and deforming the first valve member into and out of a position for restricting the flow of the first fluid to the firing chamber by selectively heating the first valve member and selectively delivering a precise quantity of second fluid through a second fluid channel to the firing chamber by providing a resiliently deformable second valve member having two portions, one portion having a different coefficient of thermal expansion than the other portion, and a heater for heating the second valve member, the second valve member being mounted within the second fluid channel and deforming the second valve member into and out of a position for restricting the flow of the second fluid to the firing chamber.

2. The method of claim 1 wherein the firing chamber includes opposed corners, the method including the step of arranging the first and second fluid channels to open near the opposed corners in the firing chamber so that swirling of the first and second fluid occurs in the firing chamber for mixing the quantity of first fluid and the quantity of second fluid in the firing chamber.

3. The method of claim 1 including the step of delivering a cleaning fluid to the firing chamber and expelling the cleaning fluid therefrom for cleaning the firing chamber between expelling successive droplets.

4. A print system for an ink-jet pen for continuously varying optical density, the print system comprising:

a printhead including a base having fluid channels defined therein, wherein a portion of a first fluid channel defines a volume for storing a basis fluid and a portion of a second fluid channel defines a volume for storing a colorant concentrate fluid;

a firing chamber defined in the printhead and having a nozzle through which droplets are ejected, the firing chamber being in fluid communication with the first fluid channel and the second fluid channel;

resiliently deformable valve members located within the first and second fluid channels and operable for restricting fluid flow through the first and second fluid channels to the firing chamber, the resiliently deformable valve members mounted within the first and second fluid channels, the valve members being deformable into and out of a position for controlling the flow of basis fluid and colorant concentrate fluid through the first and second channels and to the firing chamber; and wherein each resiliently deformable valve member comprises two portions, one portion being metal and the other portion being a polyimide, wherein one portion has a different coefficient of thermal expansion than the other portion, and a heater for heating the valve member.

5. A print system for an ink-jet pen for continuously varying optical density, the print system comprising:

a printhead including a base having fluid channels defined therein, wherein a portion of a first fluid channel defines a volume for storing basis fluid and a portion of a second fluid channel defines a volume for storing a colorant concentrate fluid;

a firing chamber defined in the printhead and having a nozzle through which droplets are ejected, the firing chamber being in fluid communication with the first fluid channel and the second fluid channel;

resiliently deformable valve members located within the first and second fluid channels and operable for restricting fluid flow through the first and second fluid channels to the firing chamber, the resiliently deformable valve members mounted within the first and second fluid channels, the valve members being deformable into and out of a position for controlling the flow of basis fluid and colorant concentrate fluid through the first and second channels and to the firing chamber; and wherein each resiliently deformable valve member comprises two portions wherein the two portions are polyimides, each portion having a different coefficient of thermal expansion than the other portion, and a heater for heating the valve member.

6. The system of claim 4 further comprising a seat carried in each of the first and second channels, the valve members moving at selected times against an associated seat to occlude the flow of basis fluid and colorant concentrate fluid through the first and second channels.

7. The system of claim 4 further comprising a recess defined within one of the first and second fluid channels, wherein one of the valve members is mounted within the recess.

* * * * *